US005458311A

United States Patent [19]

Holbrook

[11] Patent Number: 5,458,311

[45] Date of Patent: Oct. 17, 1995

[54] WALL MOUNT FOR A WIRELESS REMOTE CONTROL

[75] Inventor: Richard M. Holbrook, Redondo Beach, Calif.

[73] Assignee: Casablanca Fan Company, City of Industry, Calif.

[21] Appl. No.: 202,220

[22] Filed: Feb. 25, 1994

[51] Int. Cl.[6] ..... A47F 5/00

[52] U.S. Cl. ..... 248/309.1; 248/205.1; D14/174

[58] Field of Search ..... 248/309.1, 310, 248/220.2, 683, 674, 678, 205.1, 311.2, 312, 346; 211/13; 174/66; 220/241, 242; 340/825.69, 825.72; 250/466.1; D14/174, 218, 217, 299; D8/350, 353; D6/553, 572

[56] References Cited

U.S. PATENT DOCUMENTS 4,425,725 1/1984 Moustakas et al. ..... 40/152

FOREIGN PATENT DOCUMENTS 3155196 11/1989 Japan ..... 248/205.1

OTHER PUBLICATIONS

Hunter Installation Instructions (Wireless Remote Fan/Light Control), Hunter Fan Co., 1991 Copyright.

*Primary Examiner*—Blair M. Johnson
*Assistant Examiner*—Anita M. King
*Attorney, Agent, or Firm*—Charles H. Schwartz; Ellsworth R. Roston

[57] ABSTRACT

A wireless wall mount for a remote control for use at an existing wall switch position to receive and support a wireless remote control, including a mounting fixture adapted to be attached to the wall switch at the position of the wall switch plate. The mounting fixture including an attachment structure for receiving and supporting the wireless remote control while allowing the removal of the remote control to other remote locations.

9 Claims, 2 Drawing Sheets

FIG 3
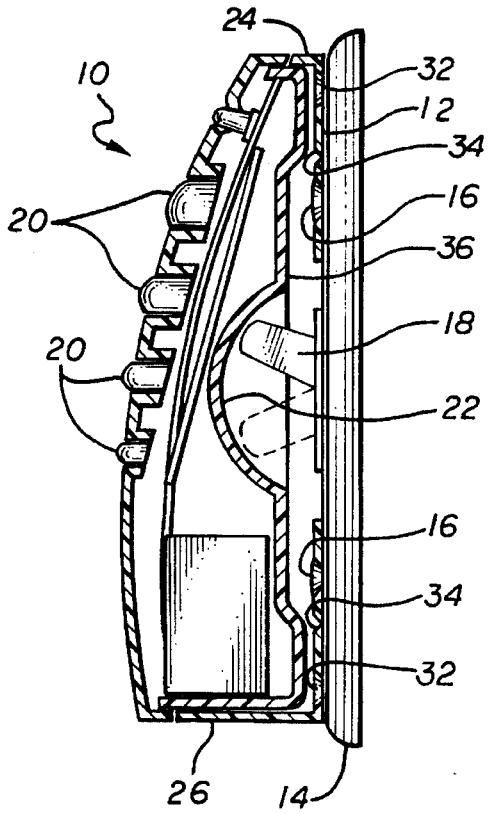
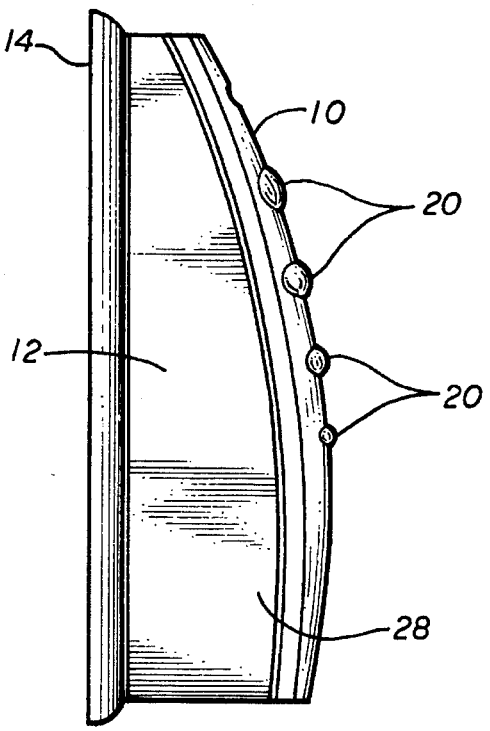
FIG. 4
FIG. 5
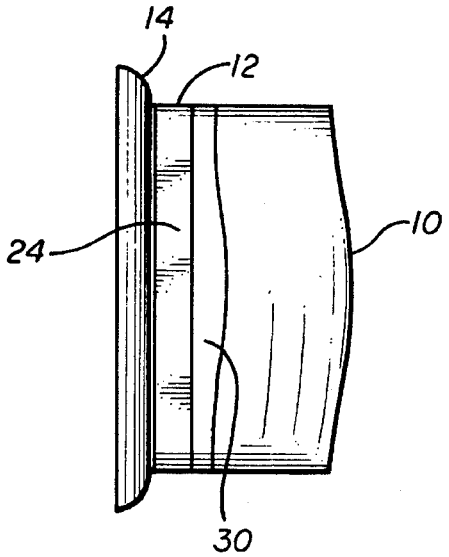

WALL MOUNT FOR A WIRELESS REMOTE CONTROL

BACKGROUND OF THE PRESENT INVENTION

The present invention relates to a wall mount for a wireless remote control.

There has been a trend in recent years to the use of wireless remote controls for use in controlling a ceiling fan and/or lighting fixture. Specifically, these remote controls may control the on/off and speed of the ceiling fan and the direction of rotation of the ceiling fan. Similarly, the remote control may control the on/off and intensity of the light from a lighting fixture. When a ceiling fan and lighting fixture are combined in a single unit, then the remote control can provide all of the above features for both the ceiling fan and the lighting fixture in an independent fashion.

Typically, the ceiling fan and/or lighting fixture is installed in an existing ceiling electrical box and with the existing wall switch used to control the application of power to the ceiling electrical box. The ceiling fan and/or lighting fixture includes a receiver unit which controls the passage of power through the existing ceiling electrical box to the newly installed fixture. Therefore, the existing wall switch can be placed in an "on" position, but no power would be passed from the existing ceiling electrical box to the fixture until the remote control is activated to send out an appropriate signal.

The above type of wireless remote appears to be superseding other types of controls. For example, one type of control requires installation of special wiring between the wall switch and the ceiling electrical box. Another type of control is more sophisticated and include a remote control which is installed in place of the wall switch but which operates on the existing wiring between the wall switch and the ceiling electrical box.

One of the difficulties with the existing wireless remote controls is that they tend to be placed at a position in the room different than the wall switch. In other words, when one enters the room and wishes, for example, to turn on a light then it is necessary to first locate where the wireless remote is located before the light can be turned on. Similarly, the ceiling fan also requires that the remote be located before the ceiling fan can be controlled.

SUMMARY OF THE PRESENT INVENTION

The present invention relates to a wireless remote control device which may be conveniently mounted over an existing wall switch. Specifically, the existing wall switch and switch plate are left in position and a special mounting fixture is provided to interlock with the existing switch plate. Alternatively, the switch plate may be replaced with a new switch plate having a construction including a mounting fixture.

Once the mounting fixture is in position, the remote control may be positioned within the mounting fixture and is also removable. In this way, the remote control may be taken to other locations within the room, but normally the remote control would be stored in a position on the wall in exactly the same place as the normal wall switch. The user of the remote control would therefore know to go to the exact same location as the wall switch in order to find the remote control which controls the light and/or ceiling fan. The user may of course take the remote control to other locations in the room to control the light and/or ceiling fan from these other locations.

The remote control includes a recessed portion at the back of the remote control which recess portion is designed to receive the normal wall switch and not interfere in any way with the wall switch. This allows the remote control of the present invention to be positioned over the existing wall switch without the necessity of removing the wall switch. The recess may have a two step configuration to operate with both normal and DECORA type wall switches.

BRIEF DESCRIPTION OF THE DRAWINGS

FIG. 3 is a cross section of the wireless remote control mounted on the wall mount illustrating the clearance or the existing wall switch;

FIG. 4 illustrates an opposite side view showing the wireless remote control extending past the wall mount; and FIG. 5 is a top view again showing the wireless remote control extending past the wall mount to facilitate removal of the remote control from the wall mount.

DETAILED DESCRIPTION OF THE INVENTION

Figure 1:
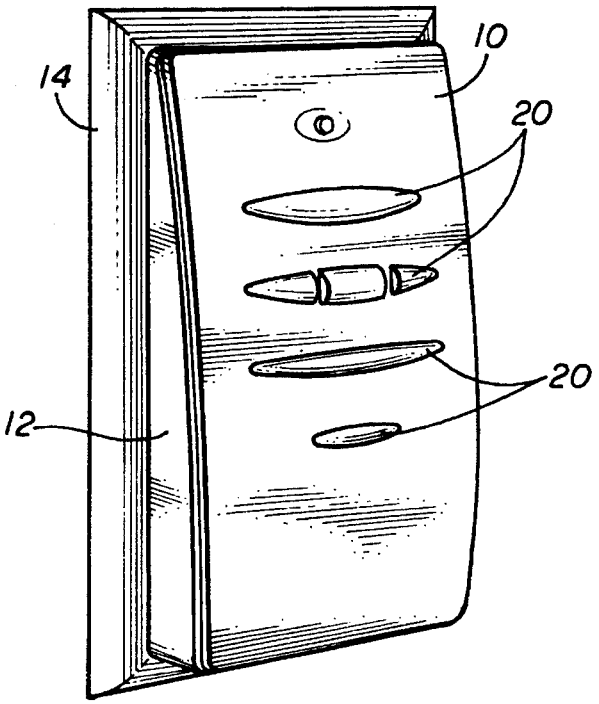
FIG. 1 illustrates a wireless remote control and wall mount of the present invention with the wireless remote located over the existing light switch.

As shown in FIG. 1 a wireless remote control 10 is shown mounted in a wall mount 12 which wall mount is secured to an existing switch plate 14.

Figure 2:
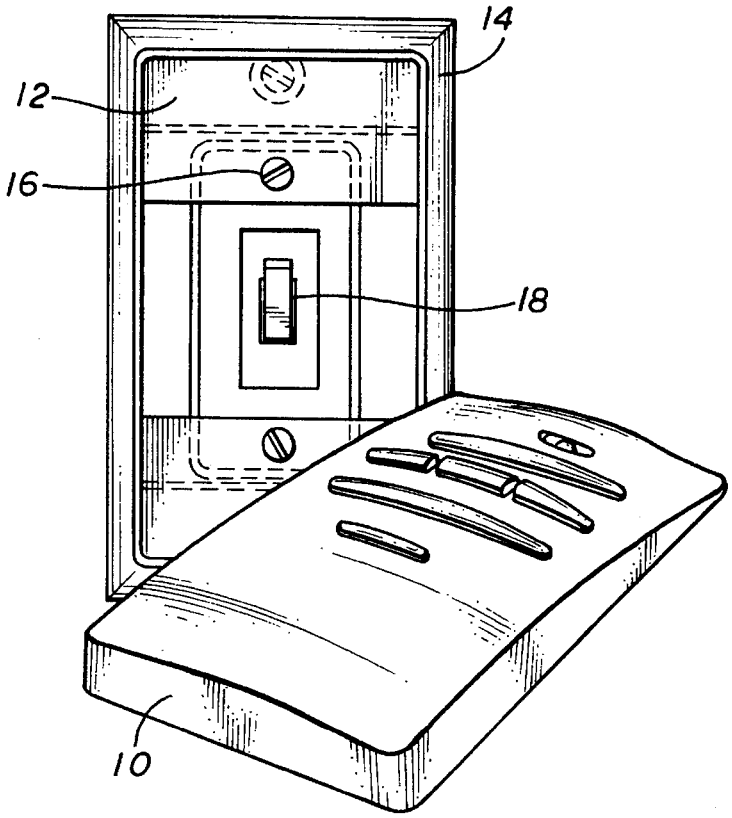
FIG. 2 illustrates the wireless remote control shown separated from the wall mount.

FIG. 2 illustrates the remote control 10 separated from the wall mount 12 and illustrates that the wall mount 12 is actually secured to the existing switch plate 14 through the use of screws 16 which may actually be the normal screws used to hold the switch plate 14 to the switch housing (not shown). It can be seen in FIG. 2 that the existing switch member 18 is exposed through an opening in the wall mount 12.

As shown in FIGS. 1 and 2 the remote control 10 includes a number of switch members 20 which control various functions at the overhead ceiling position. These functions may include controlling the light, controlling the fan, controlling the intensity of the light or speed of the fan, controlling the direction of rotation of the fan, etc. The remote control 10 uses wireless remote technology which technology forms no part of the present invention.

FIGS. 3, 4 and 5 illustrate in greater detail the construction of the remote control 10 and the complementary wall mount 12 to allow the remote to be mounted on the wall mount. This construction provides for easy removal of the remote control while still allowing the existing wall switch 18 to remain in position and be used as an overall power control for the ceiling location. As can be seen in FIG. 3, the remote control 10 includes a recess 22 at the back of the remote to allow the switch 18 to be received in either an "on" position, as shown in full line, or an "off" position, as shown in dotted line. In order to mount the wall mount 12, the screws 16 would be removed from the existing wall plate 14 and the wall mount 12 positioned over the existing plate 14 and then the screws 16 are reinserted and screwed in to lock the wall mount 12 and switch plate 14 to the switch housing (not shown).

After installation, the wall mount 12 would then be mounted as shown in FIG. 2. The switch 18 may be positioned either in an "on" or "off" position to control the application of power to the ceiling location. If the switch 18 is positioned in an "on" position, power is present at the ceiling location, but this by itself would not turn on either the ceiling fan and/or light without the ceiling unit receiving further signals provided by the remote control 10. The remote control 10 can then control the power applied to the fan and/or light using the switches 20 and this may be accomplished from any position in the room or with the remote control positioned within the wall mount 12 as shown in FIGS. 1, 3, 4 and 5.

The remote control 10 is positioned in the wall mount 12 and is held in position by the flanges 24 and 26 at the top and bottom and flanges 28 at the side. If it is desired to remove the remote control from the wall position, then the remote is pulled forward, generally using the side portions of the remote that protrudes out from the wall mount and also using the top portion of the remote which is curved to provide a shelf area 30 as shown in FIG. 5.

The present invention provides for a number of advantages. First, the use of any kind of a remote allows the replacement of the normal pull chains to provide for a greater variety in the control of the fan and light fixture. In addition, by leaving the existing wall switch in place, the ceiling fan and/or light is much easier to install. Specifically, the installer simply switches off the power, removes the old fixture, hangs the fan and puts the wall mount 12 over the existing switch plate 14. There is normally no need to shut off power at the fuse panel and no need to remove the existing wall switch located within the switch housing.

Once the wireless remote and wall mount of the present invention is installed the remote can be removed from the wall mount to be used at additional locations around the room. Since the wireless remote can be located to actually cover the power switch, it becomes substantially impossible to accidently cut off power to the fan and/or light which eliminates the necessity to reset the switch positions to the fan and light. In addition, since the wall bracket covers the power switch it can be installed on single switch plates or in switch plates that include 2, 3 or 4 switch positions.

It should also be noted that the wall mount can be adapted to work with either toggle switches as shown in FIGS. 1 and 3 or with "Decora" type switches. With this type of switch, a second position 32 can be used for the screws 16 and the portion of the wall mount below an indented section 34 can be removed to provide a larger opening for the Decora type switch. The back of the wireless remote includes a two stepped recess so that, in addition to the recessed area 22, a larger but shallower recessed area 36 is provided to receive the "Decora" type switch. The use of the "Decora" type switch is shown in dotted line in FIG. 2.

It can be seen therefore that the present invention provides for the wall mount or bracket that holds the remote transmitter directly mounted over a standard toggle switch wall plate or a "Decora" wall plate and allows the remote transmitter to snap into the mount over this existing toggle or "Decora" rocker arm switch. This provides for all of the advantages described above.

Although the invention has been described with reference to a particular embodiment, it is to be appreciated that various adaptations and modifications may be made and the invention is only to be limited by the appended claims.

I claim:

1. A wireless wall mount for a remote control for use at an existing wall switch position to receive and support a wireless remote control, including a mounting fixture adapted to be attached to the wall switch at the position of the wall switch plate, the mounting fixture including attachment means for receiving and supporting the wireless remote control while allowing the removal of the remote control to other remote locations, and a remote control and wherein the remote control includes at least one recess area at a back position to provide clearance for the wall switch so that the wall switch can be used as an overall on/off control.

2. The wireless wall mount of claim 1 wherein the mounting fixture is adapted for mounting over the existing wall switch plate using the same screw positions as the existing wall switch plate.

3. The wireless wall mount of claim 1 wherein the mounting fixture includes openings corresponding in position with the screw openings in the existing wall switch plate and with the mounting fixture having a plurality of such openings for use with either a standard toggle switch or with a flat type switch.

4. The wireless wall mount of claim 1 wherein the mounting fixture includes flange member serving as the attachment means for receiving and supporting the wireless remote control.

5. The wireless wall mount of claim 1 wherein the recess at the back of the remote control is of a sufficient depth to provide clearance for a toggle switch.

6. The wireless wall mount of claim 1 wherein the recess at the back of the remote control is of a sufficient depth to provide clearance for a flat type switch.

7. The wireless wall mount of claim 1 wherein the recess at the back of the remote control has two recess positions one of sufficient depth to provide clearance for a toggle switch and a larger but shallower recess to provide clearance for a flat type switch.

8. The wireless wall mount of claim 1 wherein the remote control extends past the attachment means of the mounting fixture to allow for the remote control to be easily removed from the mounting fixture.

9. The wireless wall mount of claim 8 wherein the front surface of the remote control is curved outwardly to provide a portion that extends further from the attachment means of the mounting fixture to facilitate the removal of the wireless remote from the mounting fixture.

* * * * *